US006481048B1

(12) United States Patent
Hauff et al.

(10) Patent No.: US 6,481,048 B1
(45) Date of Patent: Nov. 19, 2002

(54) THREE TANK CARPET SPOTTER

(75) Inventors: Douglas B. Hauff, Otis Orchard; Dennis C. Duerr, Mead, both of WA (US); Steven G. Williams, Hayden Lake, ID (US)

(73) Assignee: Palouse Holdings LLC, Hayden Lake, ID (US)

( * ) Notice: Subject to any disclaimer, the term of this patent is extended or adjusted under 35 U.S.C. 154(b) by 54 days.

(21) Appl. No.: 09/596,232

(22) Filed: Jun. 13, 2000

(51) Int. Cl.[7] ..... A47L 11/30
(52) U.S. Cl. ..... 15/321; 15/410
(58) Field of Search ..... 15/321, 320

(56) References Cited

U.S. PATENT DOCUMENTS

| | | | | | |
|---|---|---|---|---|---|
| 2,531,370 | A | * | 11/1950 | Thompson | 15/321 |
| 3,591,889 | A | | 7/1971 | Wisner | 15/321 |
| 4,153,968 | A | * | 5/1979 | Perkins | 15/321 |
| 4,244,079 | A | * | 1/1981 | Bane | 15/321 |
| 4,314,385 | A | | 2/1982 | Wimsatt et al. | 15/321 |
| 4,327,459 | A | | 5/1982 | Gilbert | 15/321 |
| 4,934,017 | A | | 6/1990 | Kent | 15/321 |
| 5,263,223 | A | | 11/1993 | Fiegel et al. | 15/321 |
| 5,784,753 | A | * | 7/1998 | Kaczmarz et al. | 15/321 X |
| 5,799,362 | A | | 9/1998 | Huffman | 15/321 |
| 5,815,869 | A | | 10/1998 | Hopkins | 8/158 |
| 5,896,617 | A | * | 4/1999 | Kasen et al. | 15/321 X |
| 5,950,273 | A | * | 9/1999 | Suhaka et al. | 15/321 X |

* cited by examiner

*Primary Examiner*—Chris K. Moore
(74) *Attorney, Agent, or Firm*—Frank J. Dykas; Robert L. Shaver; Stephen M. Nipper

(57) ABSTRACT

A three-tank carpet spot cleaning device having a cleaning fluid tank, a rinse water tank, and a recovery tank. In use, a user uses cleaning fluid to spot treat the spot, and then is able to rinse all residue of the cleaning fluid from the carpet using the rinse water.

9 Claims, 7 Drawing Sheets

THREE TANK CARPET SPOTTER

BACKGROUND OF THE INVENTION

1. Field of the Invention

The present invention generally relates to machinery used to clean carpets, and more particularly to a cleaning machines used to clean spots of soiled carpeting.

2. Background Information

The art of cleaning carpeting through applying a solution to soiled carpeting and then using a vacuum to remove said solution (and dissolved soil) from the carpeting. Such carpet cleaners typically have two tanks, one which contains a wash solution which is pumped onto the carpet, particularly where the carpet is soiled, and this solution (and dissolved soil) is sucked back out of the carpet by the carpet cleaner and into a second residual water tank. An example of such a device is shown in U.S. Pat. No. 5,799,361 (Huffman).

Other carpet cleaners have three or more tanks, for instance U.S. Pat. No. 5,263,223 to Fiegel, discloses a cleaning apparatus having separate, modular dirt collection, cleaning solution, and rinse water tanks.

Another example of a three tank carpet cleaner is shown in U.S. Pat. No. 4,327,459 to Gilbert. Gilbert discloses a carpet cleaner having a residual tank, a steam solution tank and a detergent tank. Gilbert does not disclose a separate tank of rinse water.

SUMMARY OF THE INVENTION

The present invention is a carpet spot removing device for cleaning spots of soiled carpeting. The invented device has a housing containing a cleaning solution supply reservoir containing a supply of cleaning solution to be applied to the carpeting. The housing also contains a rinse fluid supply reservoir containing a supply of a rinse fluid for rinsing the carpeting. The housing further contains a pumping means for generating a supply of pressurized cleaning solution from the cleaning solution supply reservoir and/or pressurized rinse fluid from the rinse fluid supply reservoir.

In the present invention, a user is able to select between applying pressurized cleaning solution and applying rinse fluid through a selection means, such as a toggle switch. At least one application means is then used by the present invention to apply the pressurized cleaning fluid solution and/or the pressurized rinse fluid to the carpeting. In this configuration, a user is able to apply a cleaning fluid to the soiled carpeting, suction extract the cleaning fluid and suspended soil matter, and then rinse the area with the rinse fluid. This rinse fluid (and any suspended/dissolved matter) would then be extracted as well.

Provided within the housing is a vacuum motor for generating a working air flow. This working air flow is used to extract the fluids from the carpeting. It is preferred that a power head or nozzle and hose be attached to the housing. This extracted fluid is then deposited in a recovery reservoir provided in the housing adapted to receive from the power head, the working air flow generated by the vacuum motor. After at least a portion of the extracted fluid is removed from working airflow, the working airflow is exhausted from the housing.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
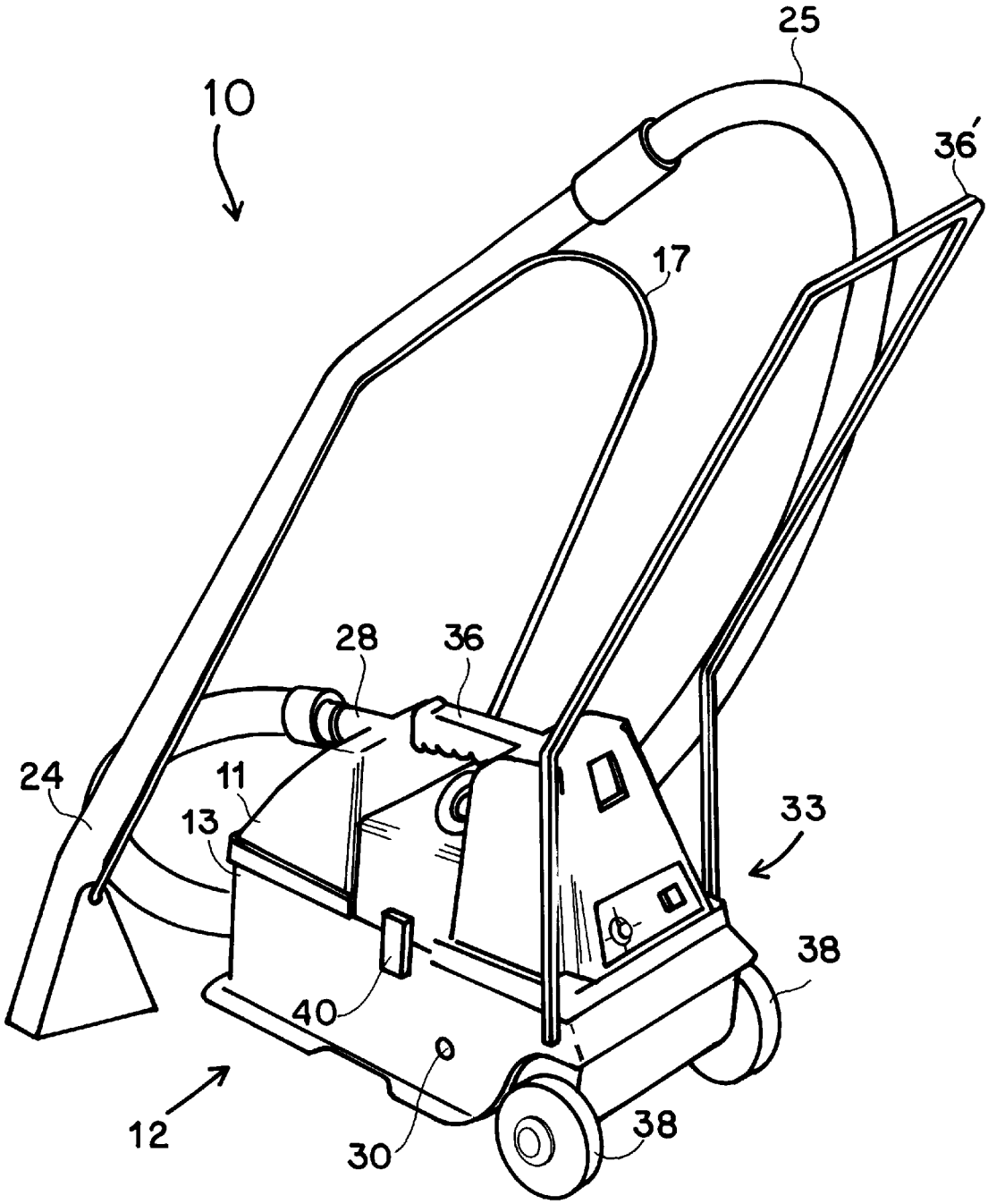
FIG. 1 is a perspective view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a carpet spot removing device 10. Initially referring to FIG. 1, the device 10 is shown having a housing 12 comprising a top (first) housing 11 and a bottom (second) housing 13. This housing 12 contains the various components of the present invention. The preferred embodiment utilizes separate top and bottom housings. The top housing 11 is latched to the bottom housing 13 through use of a latch 40 or other attachment means.

In this embodiment, able to attach to the housing 12 at an intake spout 28 is a vacuum hose 25 which preferably connects to a power head or cleaning tool 24. A fluid hose 17 for carrying pressurized cleaning fluid and rinse fluid is also provided. Airflow exhausted from the housing 12 is exhausted through an exhaust port 30. Operation of the vacuum means and selection of the pressurized fluid to be applied is controlled through control means 33 located on the housing 12.

The housing 12 preferably has at least one handle means 36, 36' for allowing a user to operate and use the device 10. It is also preferred that at least one wheel means 38 be utilized to assist the maneuverability of the device 10.

Figure 2:
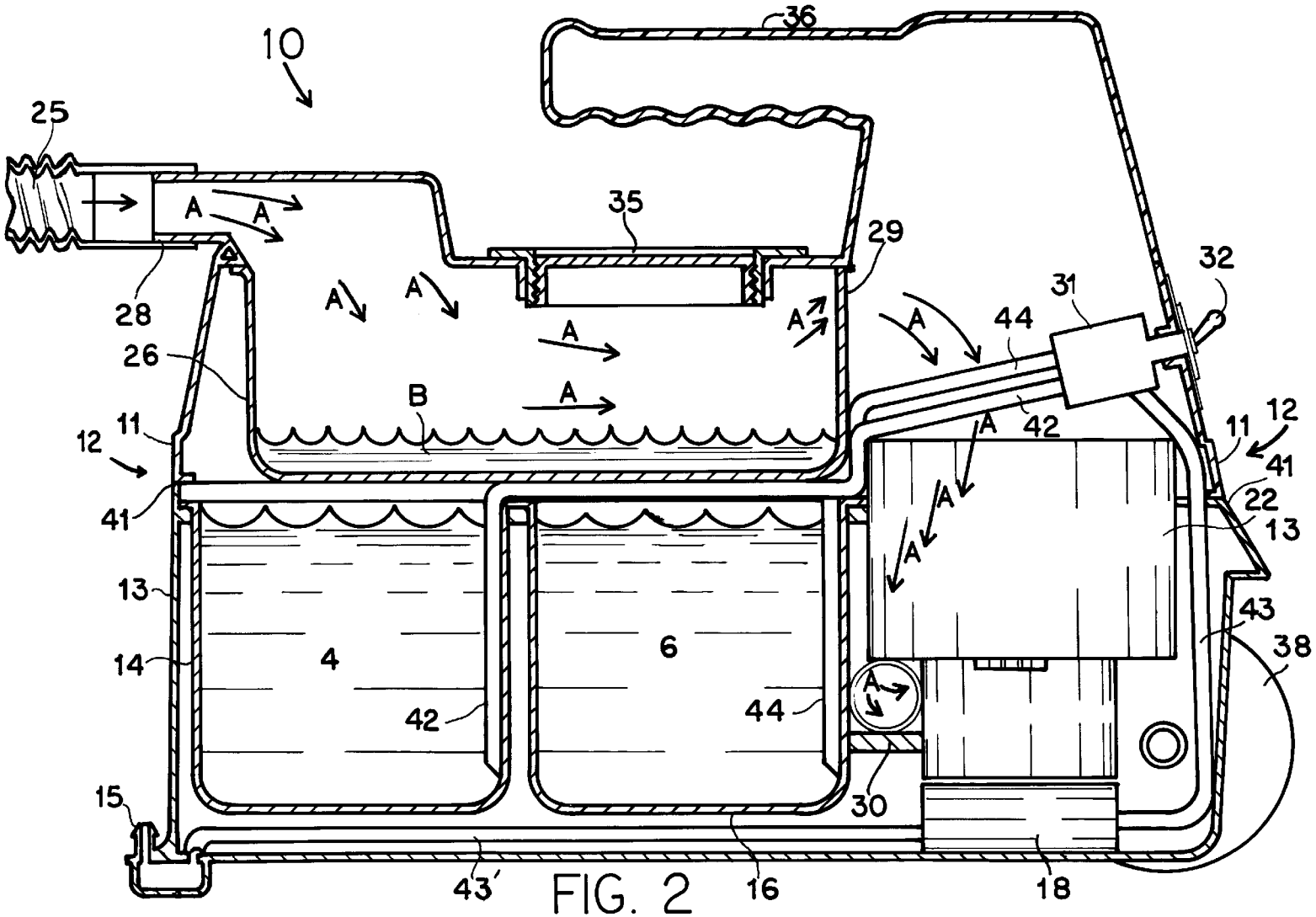
FIG. 2 is a side, cross-sectional view of the embodiment of the present invention shown in FIG. 1.

Referring now to FIG. 2, a second view of the present invention 10 is shown. In this view, the housing 12 is comprised of a top housing 11 and a bottom housing 13. The inventors prefer the use of separate housings 11, 13, however the use of a solitary housing would also be possible and is considered within the scope of the invention. A seal means 41 may be utilized to make the housing 12 more air/fluid tight.

The bottom housing 13 shown in FIG. 2 has a cleaning solution supply reservoir 14 and a rinse fluid supply reservoir 16. While the rinse fluid supply reservoir 16 is shown to the rear of the cleaning solution supply reservoir 14, any location or arrangement of these reservoirs 14, 16 is also envisioned. The rinse fluid supply reservoir 16 is for containing a supply of rinse fluid 6, such as water, for application to soiled carpeting. The cleaning solution supply reservoir 14 is for containing a supply of cleaning fluid 4, such as detergent or other cleaning chemicals, also for application to soiled carpeting.

Also contained within the housing 12 is a vacuum means 26, such as a vacuum motor. While it is preferred that the vacuum means 26 be located inside the housing 12, it is also envisioned that the vacuum means 26 could be located outside the housing 12. The vacuum means 26 is for creating a working airflow "A" in an intake spout 28 and out an exhaust port 30 of the housing 12. The preferred vacuum means 26 is an electric motor which is electrically connected to a power source.

The device 10 further has at least one pump means 18. This pump means 18 is preferably located within the housing 12 and is used to pump fluid from a valve 31 to a fluid hose connection 15 through use of solution lines 43, 43'. This pump means 18 is turned on and off through controls 33. The pump means 18, thus pressurizes fluid supplied to it from the valve 31.

The valve 31 is controlled through a selection means 32, such as a toggle switch. The valve 31 connects to a cleaning solution intake line 42 and a rinse fluid intake line 44 which are respectfully, fluidly connected with the cleaning solution reservoir 14, and the rinse fluid reservoir 16. The valve 31 thus allows a user to select which of the two fluids (4, 6) to be pumped by the pump means 18 through the fluid hose 17 and applied to the soiled carpeting.

As shown the top housing 11 contains the recovery 26. As discussed above, working airflow "A" which contains fluids, solids, and dissolved soil, is drawn into the housing 12 through the intake spout 28 by the vacuum means 22. The recovery reservoir 26 separates at least a portion of this airborme matter from the airflow "A", and the airflow "A" exits the recovery reservoir 26 at a vent 29.

When The user is trough using the device 10, or when the recovery reservoir 26 becomes full enough of extracted fluid 8 that it needs to be emptied, the user will empty the recovery reservoir 26. Emptying the recovery reservoir 26 is preferably done through the intake spout 28. First, the top housing 1I1 is detached from the bottom housing 13, and the vacuum hose 25 is detached from the intake spout. Then, the extracted fluid 8 is poured out of the intake spout 28. Optionally, a cap 35 exists as an additional place where the user can dump the extracted fluid 8 from and also as providing access to the recovery reservoir 26. Emptying of the device 10 is assisted through use of the handle 36.

Figure 3:
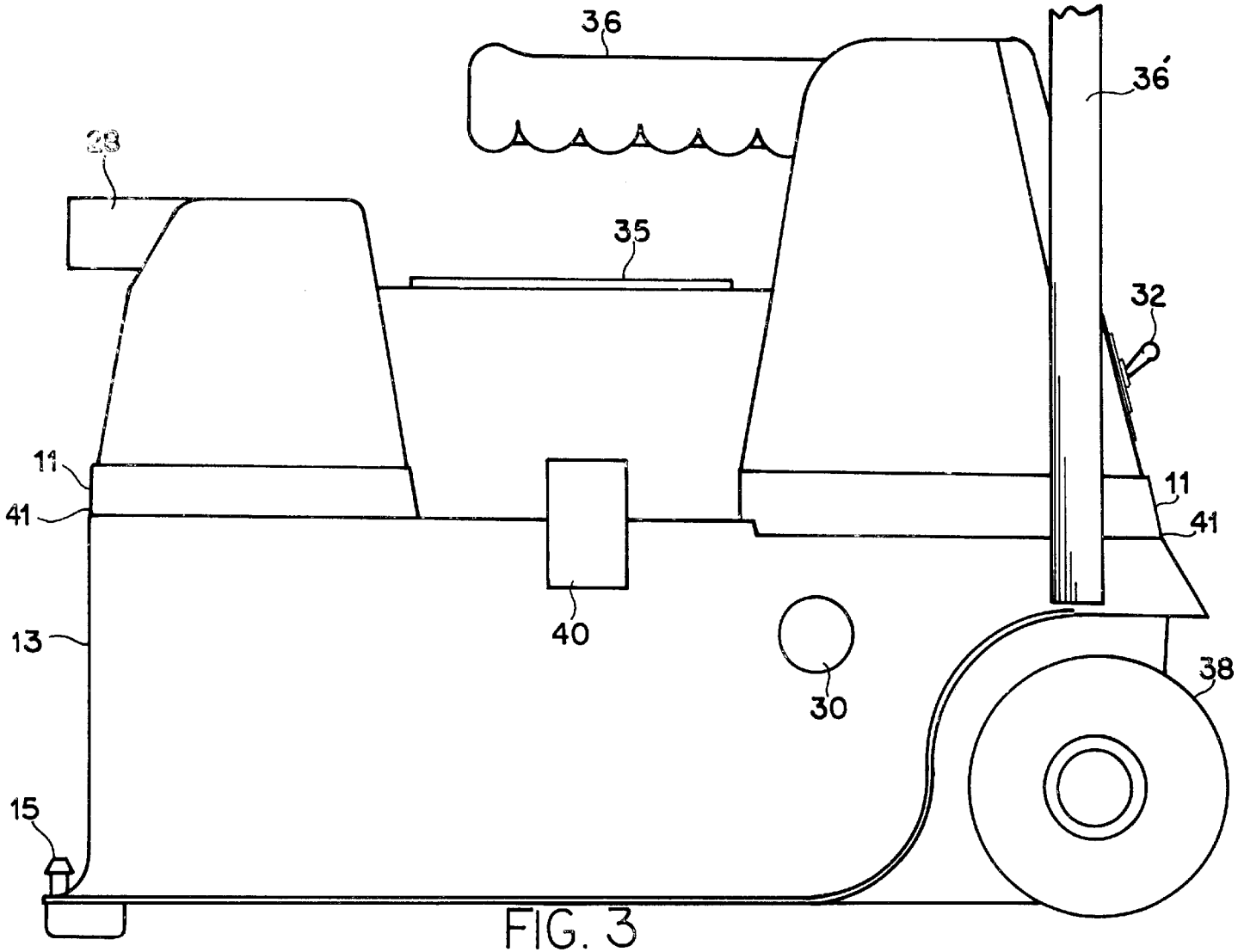
FIG. 3 is a side, partial view of the embodiment of the present invention shown in FIG. 1.

FIG. 3 shows a side view of the present invention. In this view, the latch 40 for holding the top housing 11 attached to the bottom housing 13 is shown. Other means of holding the housings 11, 13 together are also envisioned, as well as the use of a plurality of such latches 40.

Figure 4:
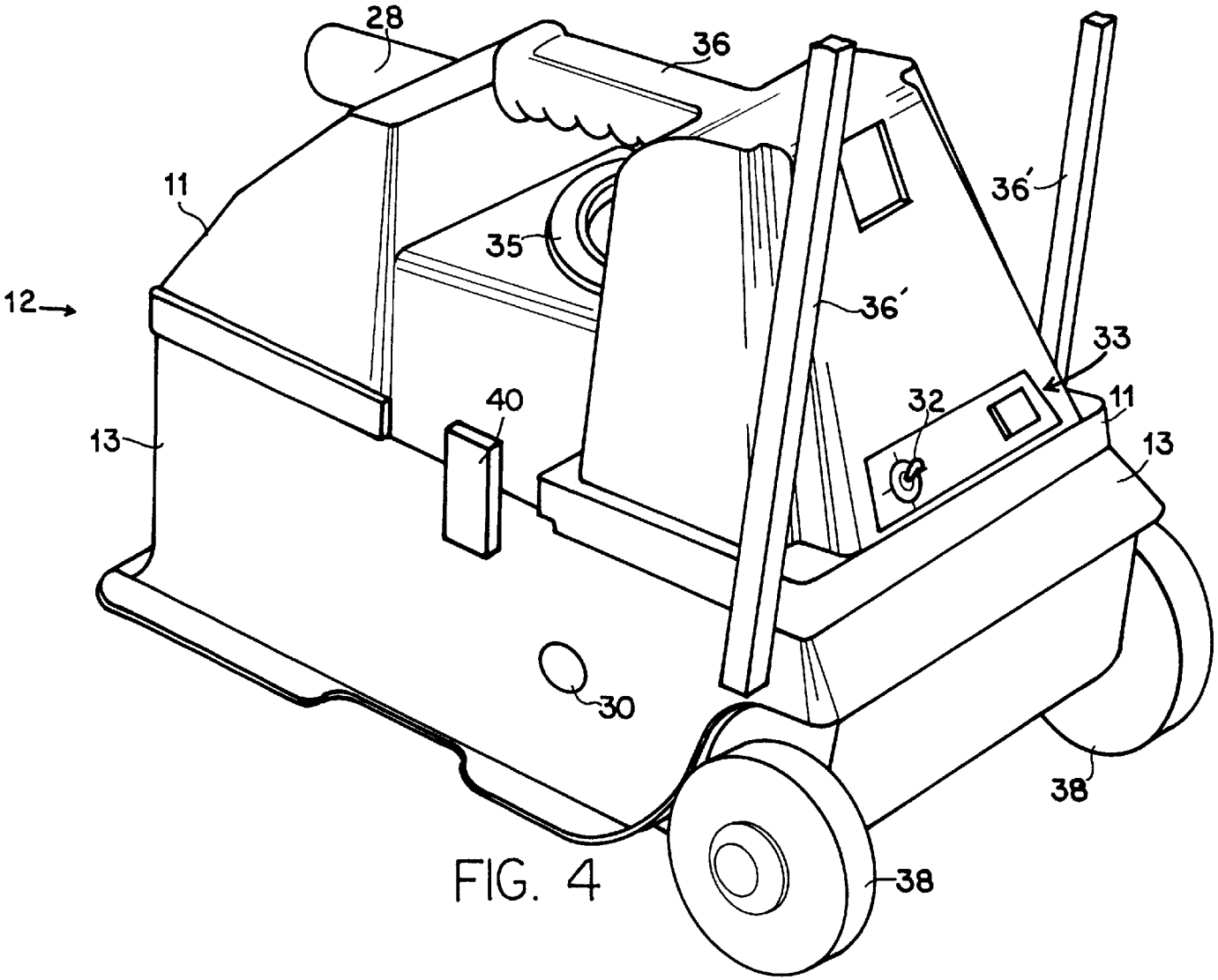
FIG. 4 is a perspective view of the embodiment of the present invention shown in FIG. 1.

FIG. 4 is a perspective view of the present invention showing the controls 33 of the device 10. These controls 33 include an on-off means 34 and a fluid selection means 32. The controls 33 could be located at other locations. The fluid selection means 32 allows the user to control which of the two fluids will be pumped by the pump. If two pumps are provided, then the selection means would control which pump is pumping.

Figure 5:
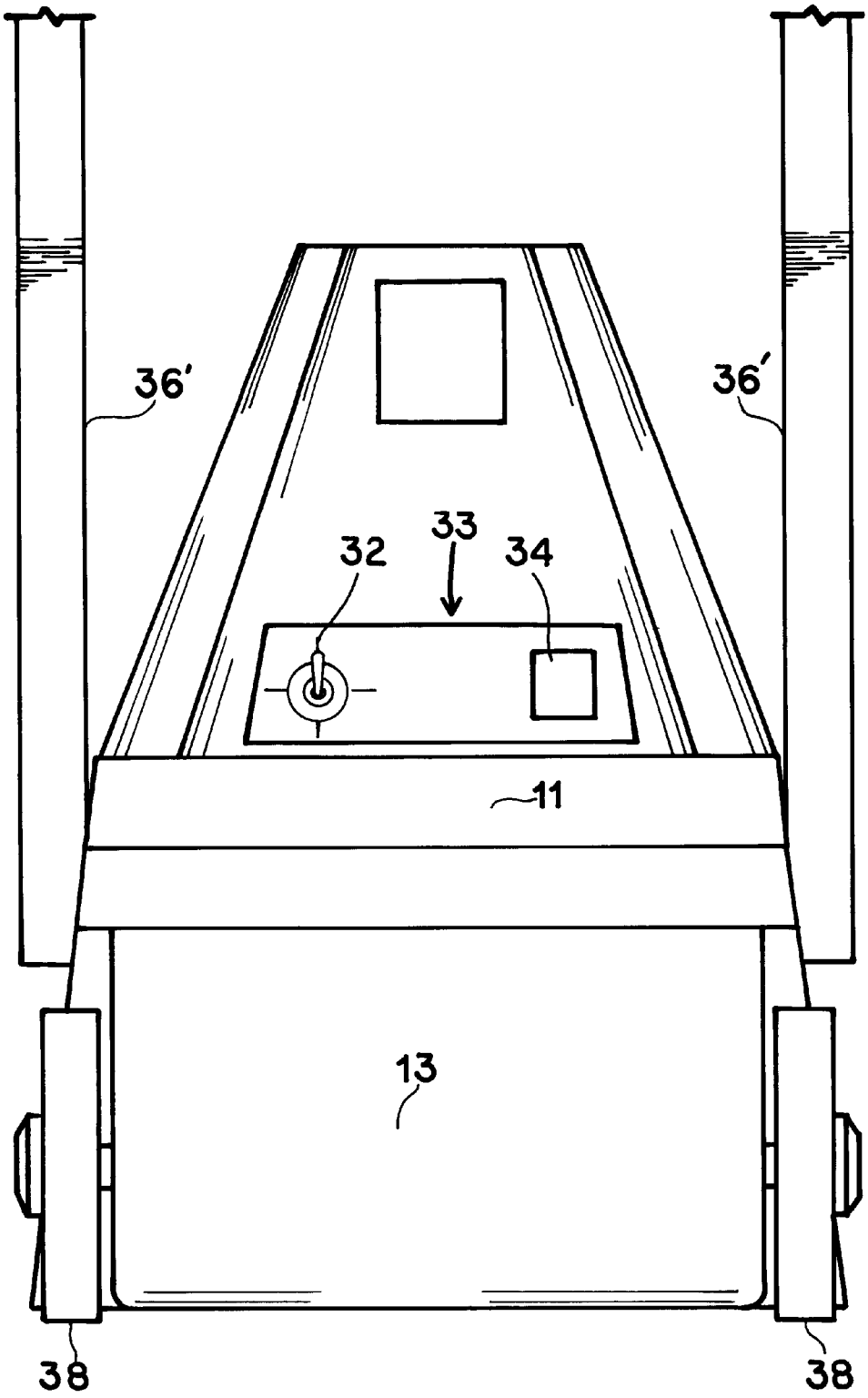
FIG. 5 is a rear end view of the embodiment of the present invention shown in FIG. 1.
Figure 6:
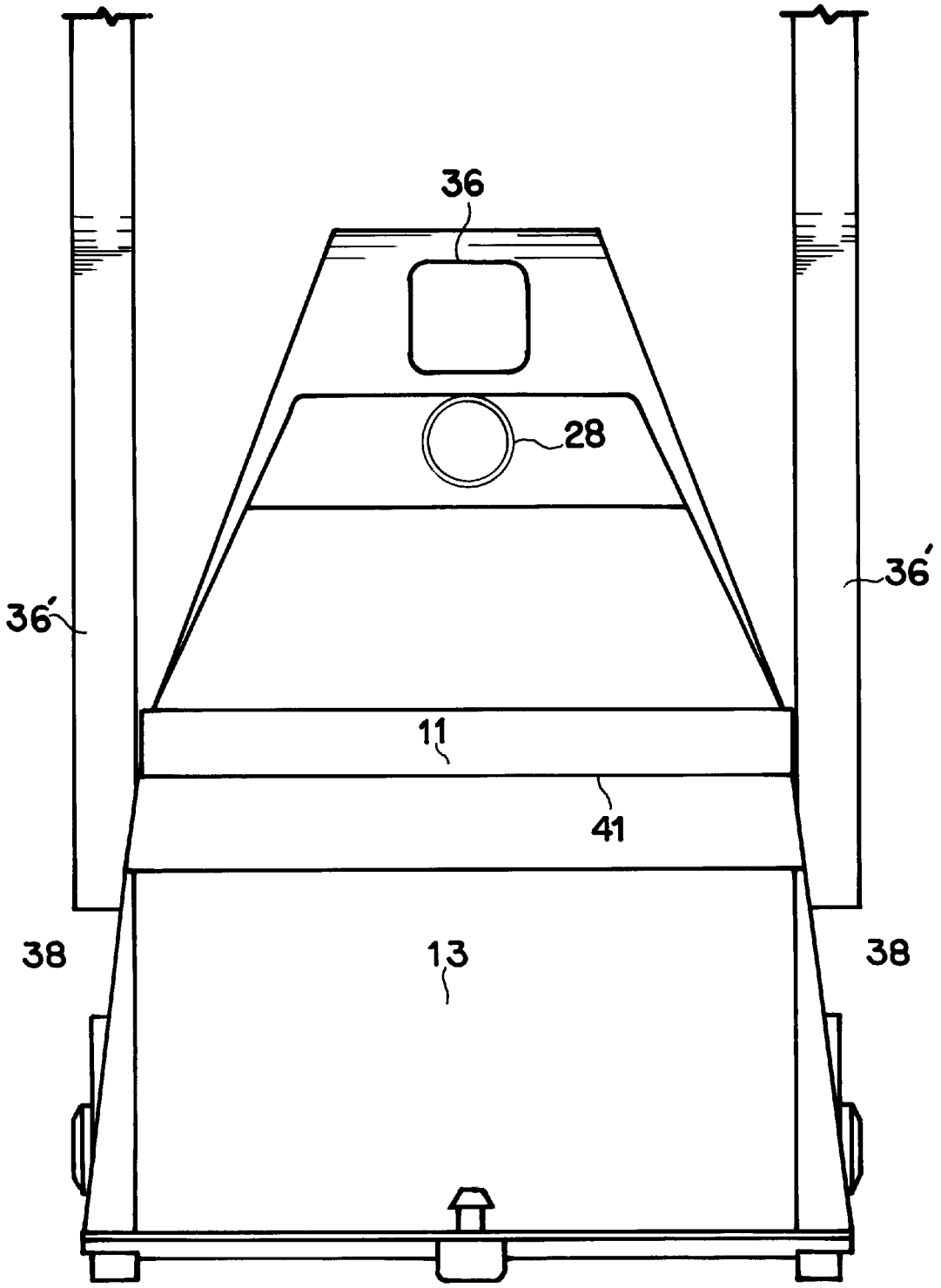
FIG. 6 is a front end view of the embodiment of the present invention shown in FIG. 1.
Figure 7:
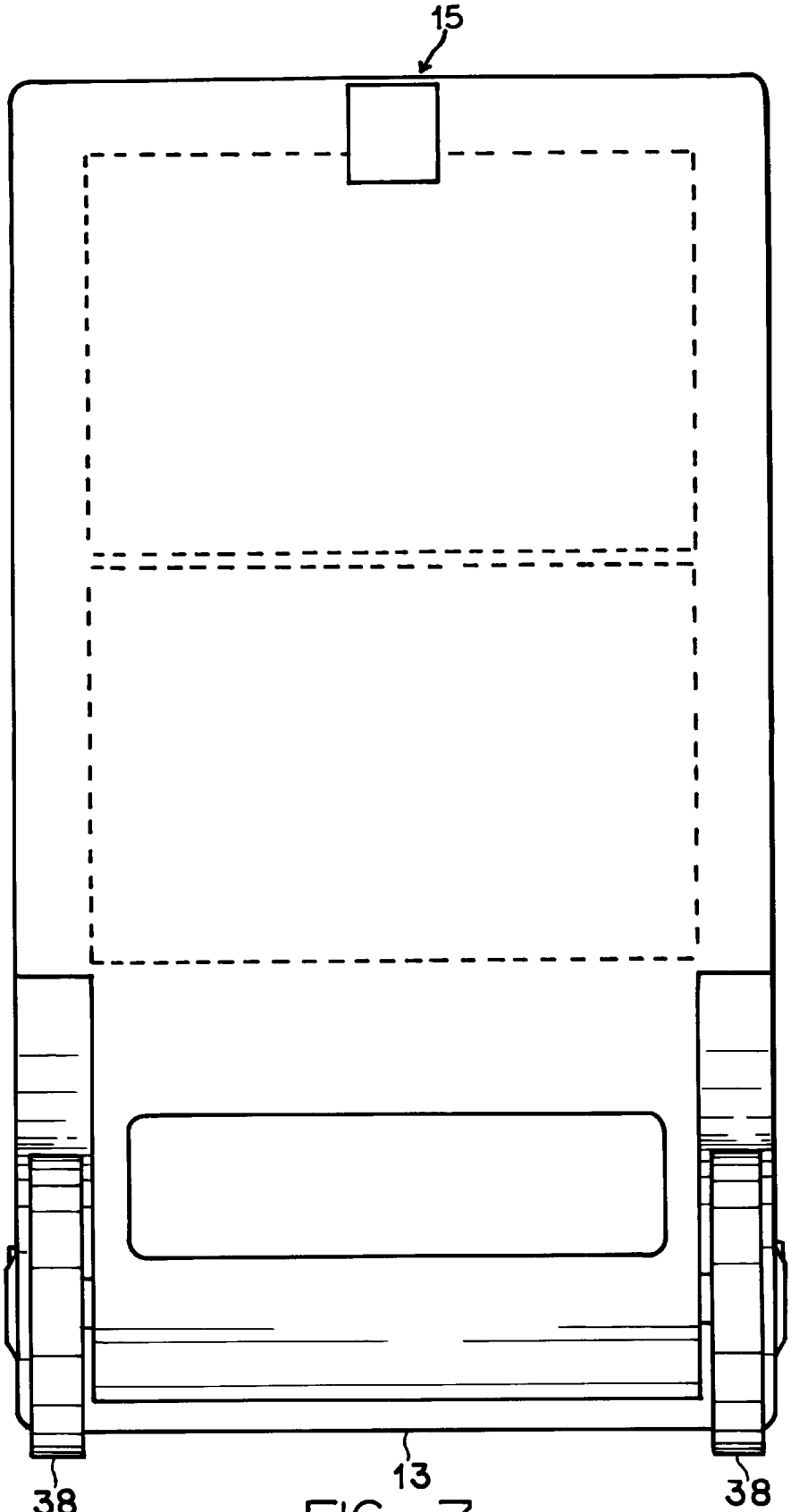
FIG. 7 is a bottom view of the embodiment of the present invention shown in FIG. 1.

FIG. 5 is a rear view of the present invention, FIG. 6 is a front view of the present invention, and FIG. 7 is a bottom view of the present invention.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A carpet spot removing device for cleaning spots of soiled carpeting, said device comprising:

a housing, said housing having a intake spout and an exhaust port;

a cleaning solution supply reservoir provided in said housing for containing a supply of cleaning solution to be applied to said carpeting;

a rinse fluid supply reservoir provided in said housing for containing a supply of a rinse fluid for rinsing said carpeting;

pumping means provided in said housing, said pumping means for generating a supply of pressurized cleaning solution from said cleaning solution supply reservoir, said pumping means for generating a supply of pressurized rinse fluid from said rinse fluid supply reservoir;

a selection means for allowing a user to select between applying said supply of pressurized cleaning solution, and applying said supply of rinse fluid;

an application means for applying said pressurized cleaning fluid solution to said carpeting;

said application means further for applying said pressurized rinse fluid to said carpeting;

a vacuum motor provided in said housing for generating a working air flow in the intake spout of said housing and out the exhaust port of said housing, said vacuum motor able to be electrically connected to a power source;

an extraction head for contacting said carpeting, said power head fluidly connected to a vacuum hose, said vacuum hose being fluidly connected to said intake spout so that said working air flow extracts cleaning fluid solution and rinse fluid applied to said carpeting; and, a recovery reservoir provided in said housing adapted to receive from the power head and vacuum hose said working air flow carrying extracted cleaning fluid solution and rinse fluid, and for separating said materials and fluids suspended in said working air flow.

2. The carpet spot removing device of claim 1, wherein said housing further comprises at least one handle means.

3. The carpet spot removing device of claim 1, wherein said housing further comprises at least one pair of wheels for contacting a floor surface.

4. The carpet spot removing device of claim 1, further comprising an on/off switch for controlling the operation of said vacuum motor.

5. The carpet spot removing device of claim 1, wherein said application means comprises a conduit from said pumping means to an applicator nozzle.

6. The carpet spot removing device of claim 1, wherein said recovery reservoir can be emptied by detaching said hose from said intake spout and pouring said materials and fluids from said intake spout.

7. The carpet spot removing device of claim 1, wherein said housing further comprises at least one access opening for allowing at least one of said reservoirs to be rinsed out.

8. Carpet spot removing device for cleaning spots of soiled carpeting, said device comprising:

a first housing, said first housing further comprising:

a first holding tank provided in said first housing for containing a cleaning solution to be applied to said carpeting;

a second holding tank provided in said first housing for containing a rinse fluid to be applied to said carpeting;

a pumping means provided in said first housing, said pumping means for generating a supply of pressurized cleaning solution from said first holding tank, said pumping means for generating a supply of pressurized rinse fluid from said second holding tank;

a switching means for selecting whether said pumping means pumps said cleaning fluid or said rinse fluid;

a vacuum motor provided in said first housing for generating a working air flow;

an application means external to said first housing, said application means for applying said pressurized cleaning fluid solution to said carpeting, said application means also for applying said pressurized rinse fluid to said carpeting;

a cleaning means external to said first housing, said cleaning means fluidly connected to said vacuum motor, said cleaning means for contacting said carpeting so that said working air flow may extract cleaning fluid solution applied to said carpeting, said cleaning means for contacting said carpeting so that said working air flow may extract rinse fluid applied to said carpeting; and, a second housing adapted to receive from said cleaning means therethrough the working air flow generated by the vacuum motor, said second housing containing a recovery reservoir for recovery of fluid from said working air flow, wherein said first housing has a intake spout, said device further having a hose able to attach between said intake spout and said cleaning means, and wherein said recovery reservoir can be emptied by detaching said hose from said intake spout and pouring said recovered fluid from said intake spout.

9. A carpet spot removing device for cleaning spots of soiled carpeting, said device comprising:

a housing;

a cleaning solution supply reservoir provided in said housing for containing a supply of cleaning solution to be applied to said carpeting;

a rinse fluid supply reservoir provided in said housing for containing a supply of a rinse fluid for rinsing said carpeting;

pumping means provided in said housing, said pumping means for generating a supply of pressurized cleaning solution from said cleaning solution supply reservoir, said pumping means for generating a supply of pressurized rinse fluid from said rinse fluid supply reservoir;

a selection means for allowing a user to select between applying said supply of pressurized cleaning solution and applying said supply of rinse fluid;

an application means for applying said pressurized cleaning fluid solution to said carpeting;

said application means further for applying said pressurized rinse fluid to said carpeting;

a vacuum motor provided in said housing for generating a working air flow, said vacuum motor able to be electrically connected to a power source;

an extraction head fluidly connected to said vacuum motor, said extraction head for contacting said carpeting so that said working air flow may extract cleaning fluid solution applied to said carpeting, said extraction head for contacting said carpeting so that said working air flow may extract rinse fluid applied to said carpeting; and, a recovery reservoir provided in said housing adapted to receive from said extraction head, the working air flow generated by the vacuum motor.

* * * * *